US007621084B2

(12) United States Patent
Bilge

(10) Patent No.: US 7,621,084 B2
(45) Date of Patent: Nov. 24, 2009

(54) SYSTEM FOR MOUNTING WALL PANELS TO A WALL STRUCTURE

(76) Inventor: Henry H. Bilge, 1036 Anderson Ave., Fort Lee, NJ (US) 07024

( * ) Notice: Subject to any disclaimer, the term of this patent is extended or adjusted under 35 U.S.C. 154(b) by 321 days.

(21) Appl. No.: 11/691,579

(22) Filed: Mar. 27, 2007

(65) Prior Publication Data

US 2008/0168723 A1 Jul. 17, 2008

Related U.S. Application Data

(63) Continuation-in-part of application No. 11/615,979, filed on Dec. 24, 2006, now Pat. No. 7,472,521.

(51) Int. Cl.
*E04F 13/07* (2006.01)
*E04B 2/18* (2006.01)

(52) U.S. Cl. ..... 52/235; 52/506.05

(58) Field of Classification Search ..... 52/235, 52/506.05, 509–512, 656.9, 463, 468, 177, 52/489.1, 483.1
See application file for complete search history.

(56) References Cited

U.S. PATENT DOCUMENTS

| | | | | | |
|---|---|---|---|---|---|
| 2,182,523 | A | * | 12/1939 | Markowski | 52/509 |
| 2,226,679 | A | * | 12/1940 | Walters | 52/512 |
| 2,395,726 | A | * | 2/1946 | Del Tufo | 52/509 |
| 3,831,506 | A | * | 8/1974 | Landheer | 454/303 |
| 4,095,385 | A | * | 6/1978 | Brugman | 52/506.08 |
| 4,344,267 | A | | 8/1982 | Sukolics | |
| 4,829,740 | A | * | 5/1989 | Hutchison | 52/475.1 |
| 4,833,839 | A | * | 5/1989 | Kurose | 52/39 |
| 5,212,914 | A | | 5/1993 | Martin et al. | |
| 5,544,461 | A | | 8/1996 | Sommerstein | |
| 5,809,729 | A | | 9/1998 | Mitchell | |
| 6,132,666 | A | * | 10/2000 | Foley et al. | 264/313 |
| 6,298,627 | B1 | | 10/2001 | Richardson | |
| 6,484,465 | B2 | | 11/2002 | Higgins | |
| 6,694,694 | B2 | | 2/2004 | Zeeff | |

(Continued)

FOREIGN PATENT DOCUMENTS

| | | | |
|---|---|---|---|
| WO | WO 00/56996 | * | 9/2000 |

OTHER PUBLICATIONS

Bamco Inc. G500 wall system.

*Primary Examiner*—Robert J Canfield
*Assistant Examiner*—Christine T Cajilig
(74) *Attorney, Agent, or Firm*—Richard M. Goldberg

(57) ABSTRACT

A system for mounting wall panels to an existing wall structure, includes a plurality of wall panels, each wall panel having a main panel section and hook walls at edges of the main panel section, with the main panel section and each hook wall having a U-shaped cross-sectional profile. There are also a plurality of fastening extrusions, each fastening extrusion including a securing section for securing the fastening extrusion to the existing wall structure, a first retaining wall structure near one end of the fastening extrusion and adjacent the securing section, the first retaining wall structure including a recess which receives one hook wall of the wall panel, and a second retaining wall structure near another end of the fastening extrusion, the second retaining wall structure including a recess which receives one hook wall of another wall panel.

17 Claims, 14 Drawing Sheets

U.S. PATENT DOCUMENTS 6,748,709 B1 * 6/2004 Sherman et al. ..... 52/235
7,210,273 B2 * 5/2007 Zahner, III ..... 52/302.3
2007/0022682 A1 2/2007 Morgenegg et al.

* cited by examiner

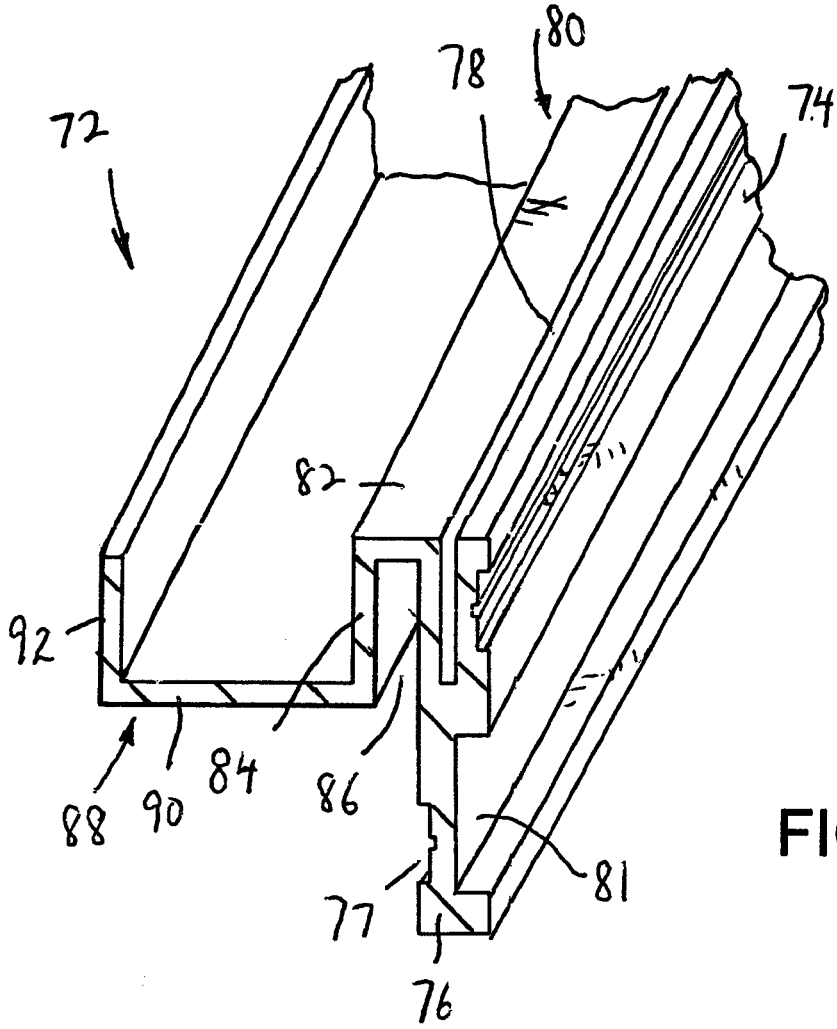
FIG. 7
FIG. 8
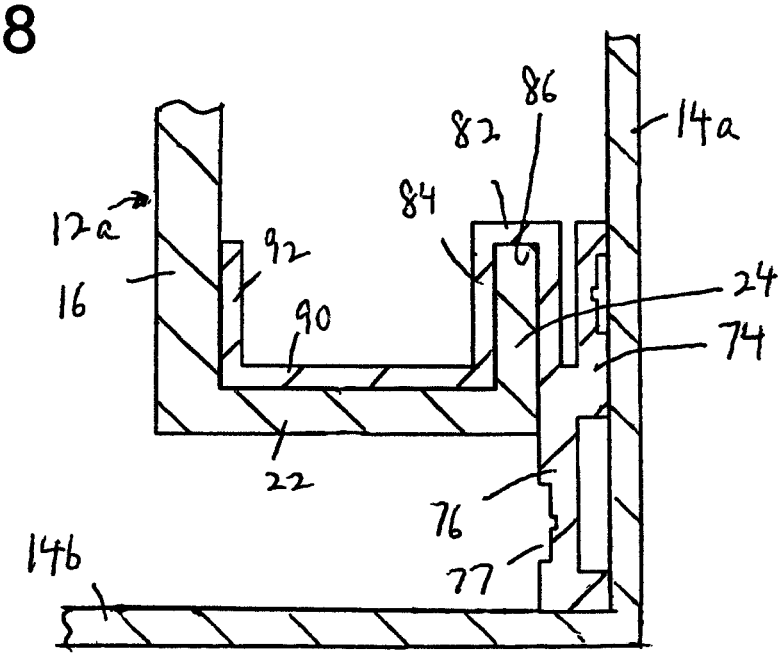

SYSTEM FOR MOUNTING WALL PANELS TO A WALL STRUCTURE

REFERENCE TO RELATED APPLICATION

The present application is a Continuation-In-Part of U.S. patent application Ser. No. 11/615,979, filed Dec. 24, 2006 by the same inventor herein and entitled SYSTEM FOR MOUNTING WALL PANELS TO A WALL STRUCTURE, now U.S. Pat. No. 7,472,521.

BACKGROUND OF THE INVENTION

The present invention relates generally to a wall system, and more particularly, to a system for easily mounting wall panels over an existing wall structure.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes some of these problems is sold by Bamco Inc. of 30 Baekeland Ave., Middlesex, N.J. 08846 under the designation "G500 WALL SYSTEM." With this system, the wall panels are provided with right angle or bends at their edges. Each planar panel and the right angle bend together form an L-shape. Each bend is secured by screws to a fastening extrusion having the same linear dimension as the wall panel, and the fastening extrusion having a generally rectangular cross-sectional configuration. At each joint area where two panels meet, there are two such fastening extrusions connected together, each secured to a respective wall panel, with an elongated hard silicone gasket between the fastening extrusions. The fastening extrusions are arranged one above the other at each joint area. Thus, the screws are not visible, thereby eliminating the unsightly appearance of previous system.

However, because of the L-shape at the bends at the edges of the wall panels, it is necessary to separately secure each bend to a fastening extrusion by screws, in addition to securing the fastening extrusions to the wall structure by screws, further increasing the work required to assemble the wall panels. Also, because the bends in the wall panels extend only in a direction perpendicular to the wall panels, the only structural support is provided by the screws which secure each bend to a fastening extrusion. As a result, it is possible to loosen and/or pull out the wall panels.

In addition, in order to secure the fastening extrusions to existing wall structures, one of the connected pair of fastening extrusions is provided with an extension which is separately secured to the existing wall structure. This means that the main bodies of the fastening extrusions are spaced away from the existing wall structure, thereby providing a further weak link in the structure, besides making it more difficult to assemble.

SUMMARY OF THE INVENTION

Accordingly, it is an object of the present invention to provide a wall system that overcomes the aforementioned problems.

It is another object of the present invention to provide a wall system which does not require the use of screws to secure the wall panels to the fastening extrusions.

It is still another object of the present invention to provide a wall system in which the wall panels have U-shaped hooks at their edges which are securely held at the fastening extrusions without any screws or other fastening devices.

It is yet another object of the present invention to provide a wall system that is easy to assemble with an existing wall structure.

It is a further object of the present invention to provide a wall system in which the fastening extrusions are secured flush against the existing wall structure by fastening devices, thereby increasing the structural integrity thereof.

It is a still further object of the present invention to provide a wall system that is easy and economical to manufacture and use.

In accordance with an aspect of the present invention, a system for mounting wall panels to an existing wall structure, includes a plurality of wall panels, each wall panel having a main panel section and hook walls at edges of the main panel section, with the main panel section and each hook wall having a U-shaped cross-sectional profile. There are also a plurality of fastening extrusions, each fastening extrusion including a securing section for securing the fastening extrusion to the existing wall structure, a first retaining wall structure near one end of the fastening extrusion and adjacent the securing section, the first retaining wall structure including a recess which receives one hook wall of the wall panel, and a second retaining wall structure near another end of the fastening extrusion, the second retaining wall structure including a recess which receives one hook wall of another wall panel.

The main panel section has a rectangular configuration with four hook walls, and there are four fastening extrusions, with the recess of the retaining wall of each fastening extrusion receiving one hook wall of the wall panel.

Each fastening extrusion includes a planar section having a length, with the first retaining wall structure and the second retaining wall structure extend from a same side of the planar section. The first retaining wall structure is spaced from the one end of the fastening extrusion, and the securing section includes a tail section of the planar section which extends between the one edge and the first retaining wall. Preferably, each retaining wall structure has an L-shaped cross-sectional profile which faces the L-shaped cross-sectional profile of the other retaining wall structure. Also, at least one of the L-shaped cross-sectional profiles can be angled away from the planar section by a small angle. Thus, the planar section and each retaining wall structure together define a U-shaped cross-sectional profile that defines the respective recess.

A corner fastening extrusion is provided for starting assembly at a corner wall. The corner fastening extrusion includes a planar wall section for securing the fastening extrusion to the existing wall structure, and a first retaining wall structure near one end of the planar wall section, the first retaining wall structure including a recess which receives one hook wall of a wall panel. The corner fastening extrusion is used at edges of a respective wall panel corresponding to corners between a side wall and floor, two side walls, and a side wall and a ceiling.

There is also at least one channel secured to the securing sections of adjacent fastening extrusions and positioned between adjacent wall panels corresponding thereto. An elongated plug is inserted into each channel for closing off the channel.

In accordance with another aspect of the present invention, a system for mounting wall panels to an existing wall structure, includes a plurality of wall panels, each wall panel having a main panel section and hook walls at edges of the main panel section, with the main panel section and each hook wall having a U-shaped cross-sectional profile. A plurality of first fastening extrusion assemblies are provided. Each fastening extrusion assembly includes a securing section for securing the fastening extrusion assembly to the existing wall structure, a first retaining wall structure near one end of the fastening extrusion assembly and adjacent the securing section, the first retaining wall structure including a first recess which receives one hook wall of the wall panel and a second recess, and a second retaining wall structure near another end of the fastening extrusion assembly, the second retaining wall structure including a third recess which receives one hook wall of another wall panel and a fourth recess. A second fastening extrusion assembly is also provided, each second fastening extrusion assembly including a securing section for securing the second fastening extrusion assembly to the existing wall structure, and a first L-shaped retaining wall structure near one end of the fastening extrusion, the first L-shaped retaining wall structure extending into one of the second and fourth recess.

Each of the first fastening extrusion assemblies includes a first fastening extrusion and a second fastening extrusion. A first one of the fastening extrusions includes a tongue and a second one of the fastening extrusions includes a groove for receiving the tongue to connect together the first and second fastening extrusions when the first fastening extrusion is assembled with a first wall panel and the second fastening extrusion is assembled with a second wall panel. A depth of each tongue is greater than a depth of each groove such that each tongue does not fit entirely in the respective groove.

There is also at least one channel secured to the first and second fastening extrusion assemblies and positioned between adjacent wall panels corresponding thereto. An elongated plug is inserted into each channel for closing off the channel.

The main panel section has a rectangular configuration with four hook walls, and there are four first and second fastening extrusion assemblies associated with each main panel section, with the first and third recesses of the first and second retaining walls receiving one hook wall of the wall panel.

There is also a starter extrusion for starting assembly at a corner wall, including a securing section for securing the starter extrusion to the existing wall structure, and a first retaining wall structure connected with the securing section of the starter extrusion and including a fifth recess which receives one hook wall of another wall panel and a sixth recess. There is also a corner fastening extrusion for starting assembly at a corner wall, the corner fastening extrusion including a planar wall section for securing the corner fastening extrusion to the existing wall structure, and a first retaining wall structure at one end of the planar wall section, the first retaining wall structure including an L-shaped retaining wall structure extending into the sixth recess. The starter extrusion and corner fastening extrusion are used at edges of a respective the wall panel corresponding to corners between a side wall and floor, two side walls, and a side wall and a ceiling.

The above and other features of the invention will become readily apparent from the following detailed description thereof which is to be read in connection with the accompanying drawings.

BRIEF DESCRIPTION OF THE DRAWINGS

FIG. 7 is a perspective view of a starter extrusion;

FIG. 8 is a vertical cross-sectional view showing the starter extrusion mounting a wall panel adjacent a floor;

DETAILED DESCRIPTION

Figure 1:
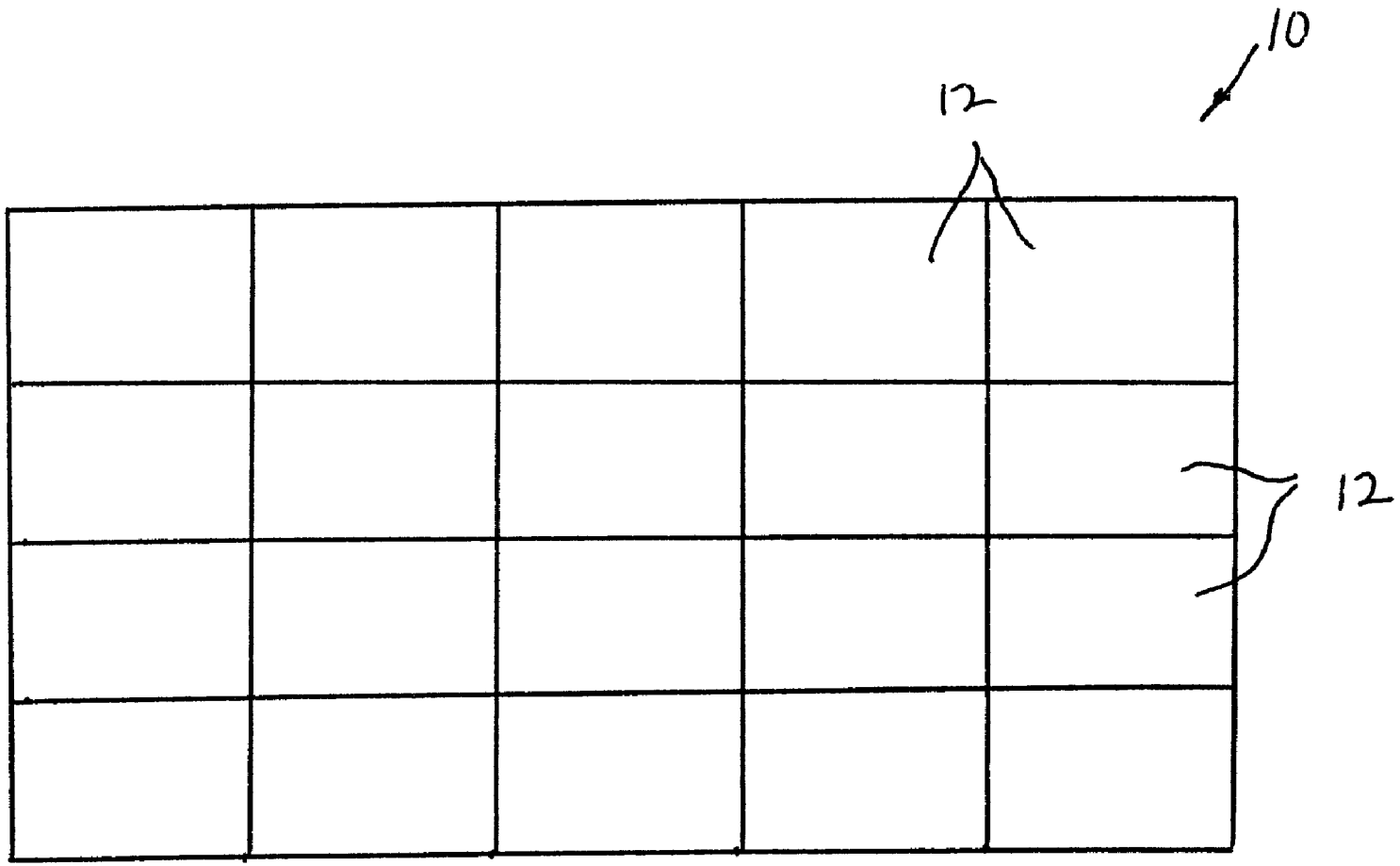
FIG. 1 is an elevational view of a plurality of wall panels mounted to an existing wall structure.

Referring to the drawings in detail, and initially to FIG. 1-4 thereof, there is shown a system 10 according to a first embodiment of the present invention for easily mounting wall panels 12 over an existing wall structure 14. Wall structure 14 preferably includes any planar wall. Each panel 12 includes a rectangular shaped, planar main panel section 16 and an L-shaped bend 18 at each edge. As a result, planar panel section 12, together with L-shaped bend 18, forms a U-shaped hook structure 20 at each edge. Specifically, each L-shaped bend 18 includes a first right angle panel section 22 at each free side edge of main panel section 16 which extends at a right angle away from main panel section 16, and a second right angle panel section 24 which extends inwardly at a right angle from the free side edge of first right angle panel section 22 such that each second right angle panel section 24 is positioned behind main panel section 16 in spaced, parallel relation thereto.

Main fastening extrusions 26 are provided for securing each wall panel 12 to existing wall structure 14. Each main fastening extrusion 22 includes a first fastening extrusion 28 and a second fastening extrusion 30 secured to first half fastening extrusion 28.

Figure 3:
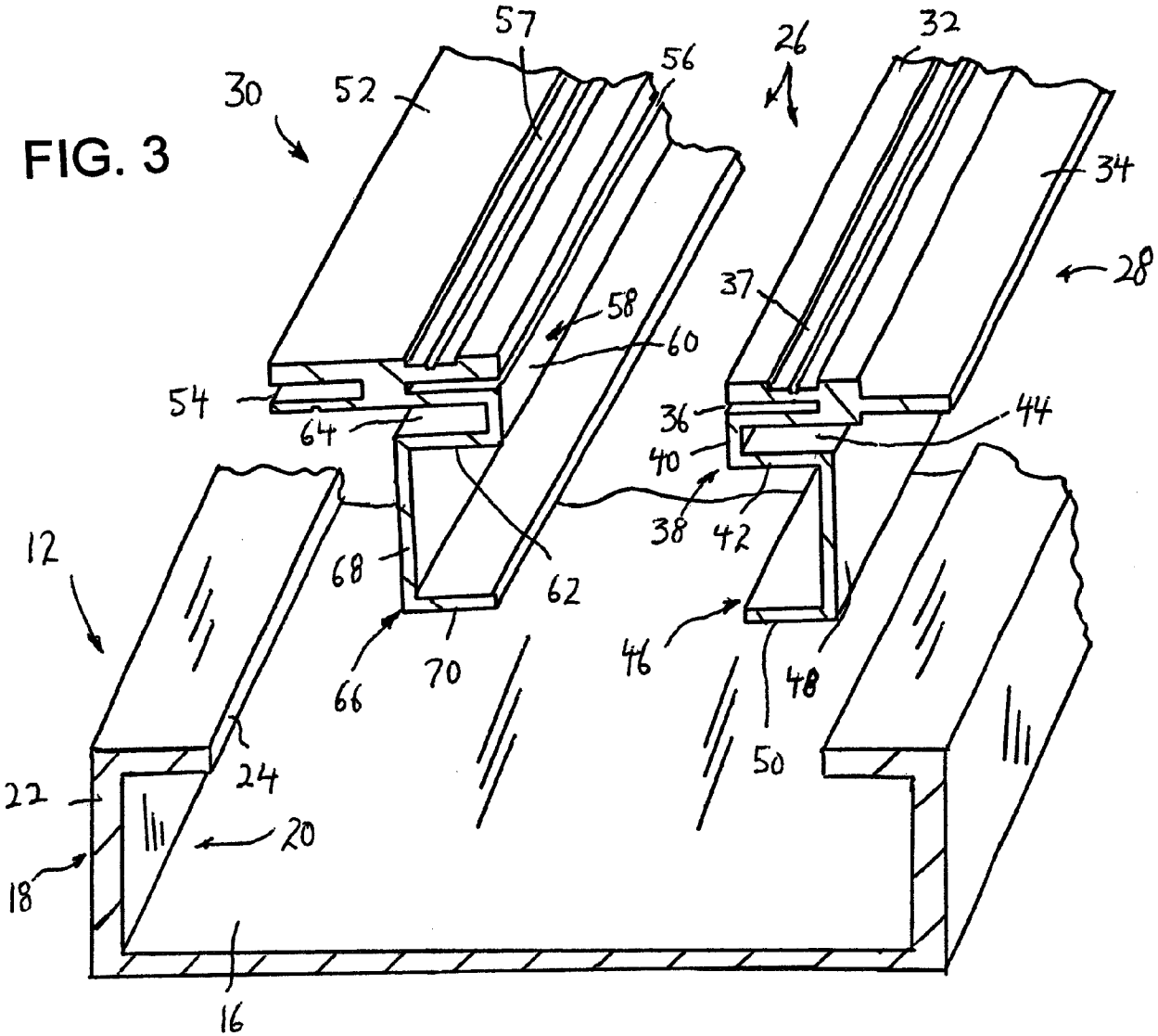
FIG. 3 is an exploded, perspective view, partially in section, showing a wall panel and two extrusions.
Figure 4:
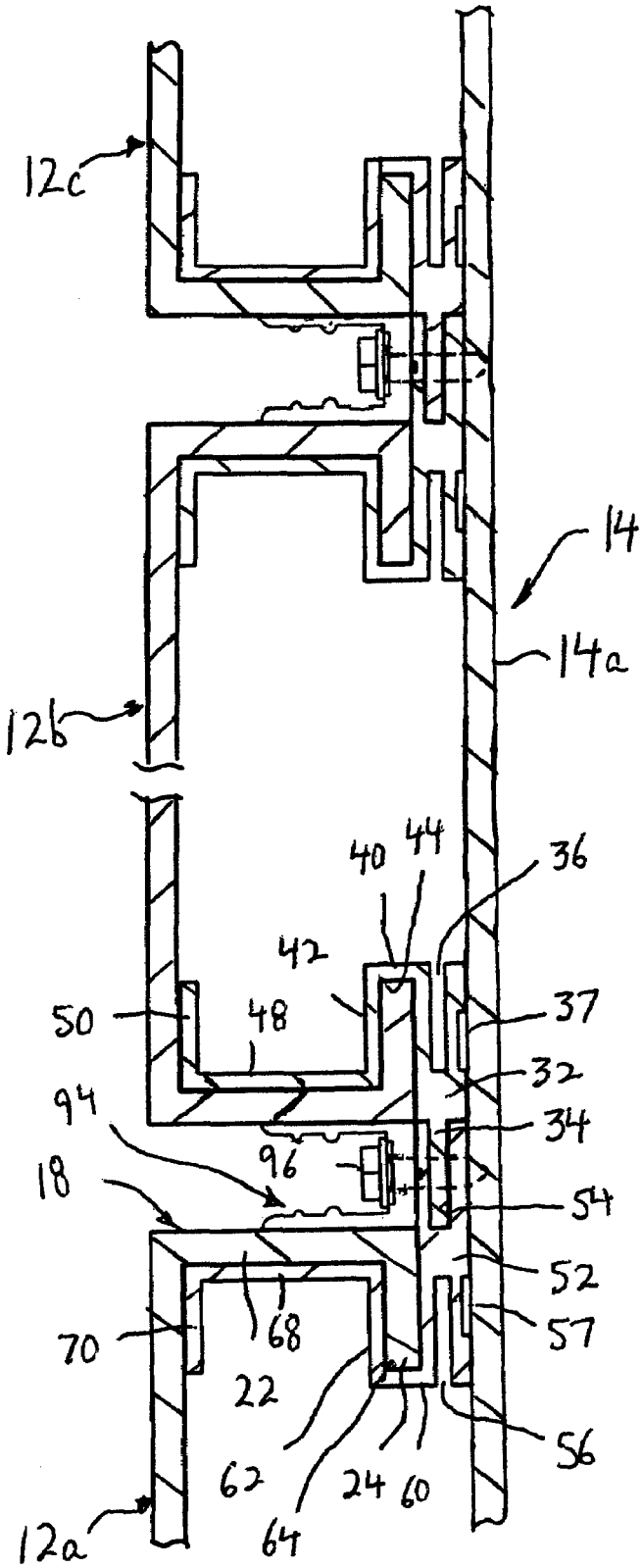
FIG. 4 is a vertical cross-sectional view showing a plurality of wall panels secured to an existing wall structure by the extrusions.

As shown best in FIGS. 3 and 4, first fastening extrusion 28 includes an elongated planar section 32 that is positioned flush against existing wall structure 14 with a horizontal orientation. A tongue 34 extends in parallel, coplanar relation along one side edge of elongated planar section 32, with the thickness of tongue 34 being less than the thickness of planar section 32. The opposite elongated side edge of planar section 32 includes a recess 36 therein. Recess 36 can extend the entire length of planar section 32, or alternatively, can be formed only at the ends of planar section 32. A shallow channel 37 is formed in the outer surface of planar section 32 in alignment with recess 36.

A U-shaped retaining wall 38 is formed at the opposite side edge of elongated planar section 32, immediately below recess 36. Specifically U-shaped retaining wall 38 is defined by planar section 32, a first right angle retaining wall section 40 at the opposite side edge of elongated planar section 32 and extending at a right angle away from planar section 32, and a second right angle retaining wall section 42 at the outer free side edge of first right angle retaining wall section 40 and extending at a right angle thereto, such that second right angle retaining wall section 42 is positioned in front of elongated planar section 32 and in spaced, parallel relation thereto. U-shaped retaining wall 32 thereby defines an inwardly directed recess 44 therein for receiving second right angle panel section 24 of hook structure 20 of a respective wall panel 12.

An L-shaped stabilizing wall 46 is secured to the free side edge of second right angle retaining wall section 42. L-shaped stabilizing wall 46 includes a first stabilizing wall section 48 secured to the free side edge of second right angle retaining wall section 42 and extending outwardly at a right angle therefrom, and a second stabilizing wall section 50 secured to the free side edge of first stabilizing wall section 48 and extending outwardly at a right angle therefrom, such that each second stabilizing wall section 50 is positioned in parallel, spaced apart relation to second right angle retaining wall section 42.

Figure 6:
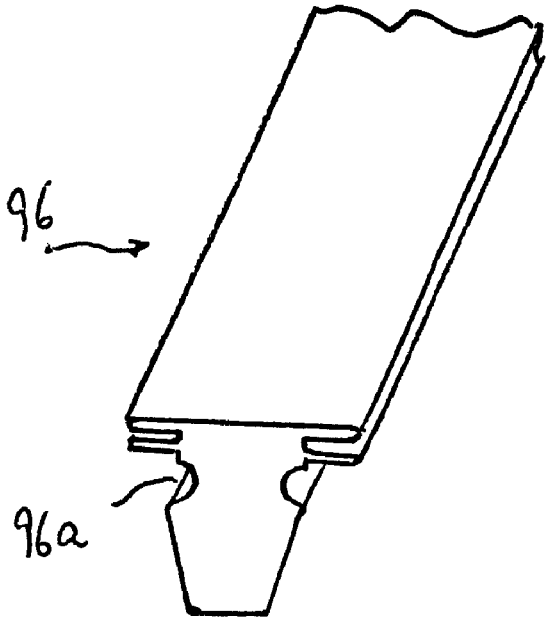
FIG. 6 is a perspective view of a rubber plug for insertion i the U-shaped channel.

In like manner, as shown best in FIGS. 3 and 6, second fastening extrusion 30 includes an elongated planar section 52 that is positioned flush against existing wall structure 14 with a horizontal orientation. A groove 54 extends in parallel relation along one side edge of elongated planar section 52, with the opening dimension of groove 54 corresponding to the thickness of tongue 34 in order to receive tongue 34 therein. The opposite elongated side edge of planar section 52 includes a recess 56 therein. Recess 56 can extend the entire length of planar section 52, or alternatively, can be formed only at the ends of planar section 52. A shallow channel 57 is formed in the outer surface of planar section 52 in alignment with recess 56.

A U-shaped retaining wall 58 is formed at the opposite side edge of elongated planar section 52, immediately below recess 56. Specifically U-shaped retaining wall 58 is defined by planar section 52, a first right angle retaining wall section 60 at the opposite side edge of elongated planar section 52 and extending at a right angle away from planar section 52, and a second right angle retaining wall section 62 at the outer free side edge of first right angle retaining wall section 60 and extending at a right angle thereto, such that second right angle retaining wall section 62 is positioned in front of elongated planar section 52 and in spaced, parallel relation thereto. U-shaped retaining wall 58 thereby defines an inwardly directed recess 64 therein for receiving second right angle panel section 24 of hook structure 20 of a respective wall panel 12.

An L-shaped stabilizing wall 66 is secured to the free side edge of second right angle retaining wall section 62. L-shaped stabilizing wall 66 includes a first stabilizing wall section 68 secured to the free side edge of second right angle retaining wall section 62 and extending outwardly at a right angle therefrom, and a second stabilizing wall section 70 secured to the free side edge of first stabilizing wall section 68 and extending outwardly at a right angle therefrom, such that each second stabilizing wall section 70 is positioned in parallel, spaced apart relation to second right angle retaining wall section 62.

Figure 2:
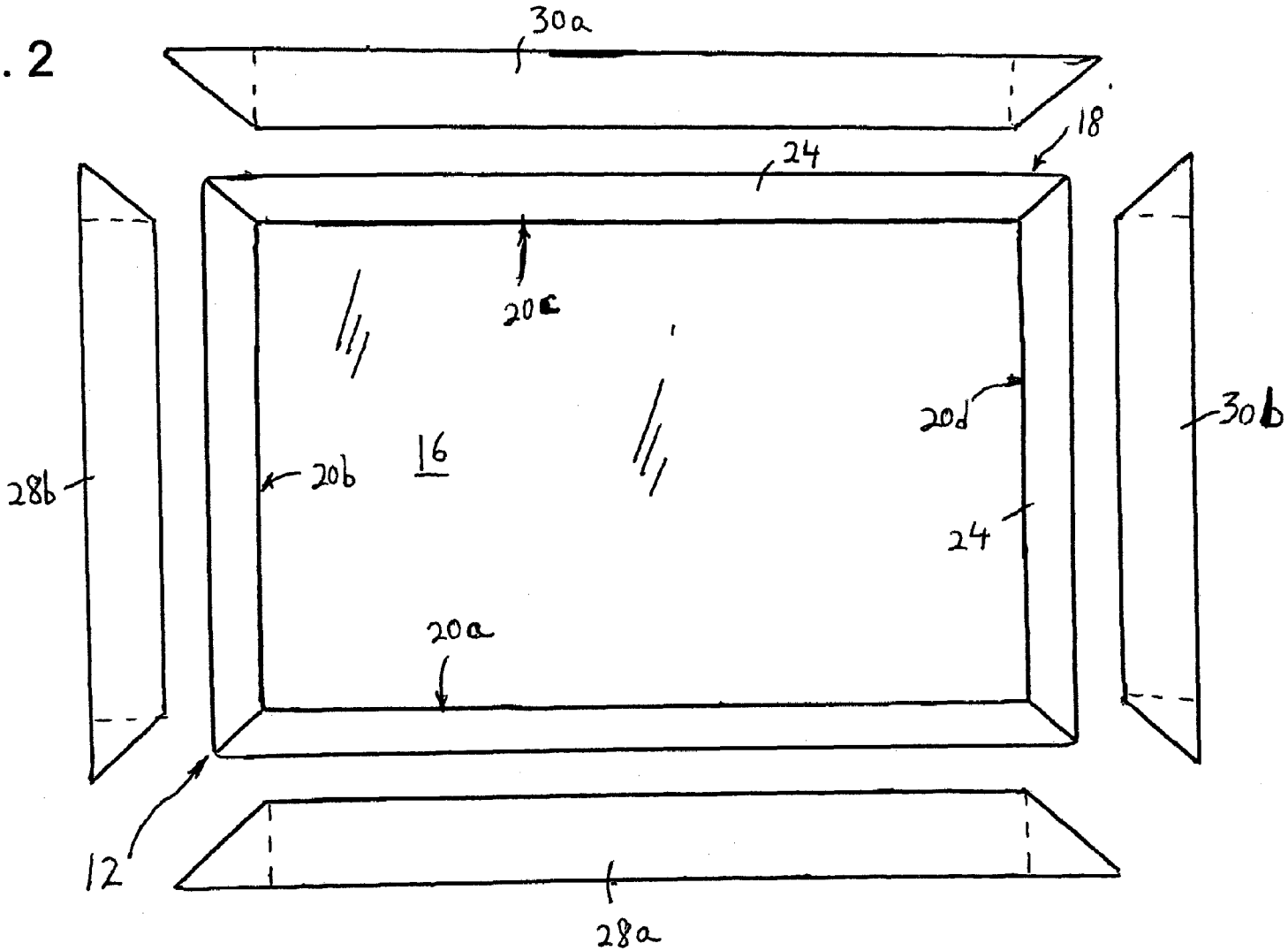
FIG. 2 is an exploded, rear plan view of a wall panel and four extrusions.

With this arrangement, panels 12 and extrusions 28 and 30 are first assembled in a shop such that two first fastening extrusions 28 and two second fastening extrusions 30 are first secured to each wall panel 12. Specifically, as shown in FIG. 2, a first fastening extrusion 28*a* is engaged with a U-shaped hook structure 20*a* at a first edge of a wall panel 12 such that second right angle panel section 24 is engaged within inwardly directed recess 44 and such that L-shaped stabilizing wall 46 is engaged within U-shaped hook structure 20. Another first fastening extrusion 28*b* is engaged in the same manner with a U-shaped hook structure 20*b* at an adjacent second edge of wall panel 12. Then, a second fastening extrusion 30*a* is engaged with a U-shaped hook structure 20*c* at a third edge of a wall panel 12 such that second right angle panel section 24 is engaged within inwardly directed recess 64 and such that L-shaped stabilizing wall 66 is engaged within U-shaped hook structure 20*c*. Another second fastening extrusion 30*b* is engaged in the same manner with a U-shaped hook structure 20*d* at an adjacent edge of wall panel 12. It will be appreciated that the ends of extrusions 28 and 30 are beveled, as shown in FIG. 2, in order meet in edge to edge contact when assembled with wall panel 12. However, this is not a requirement of the present invention, and the edges can be square, as shown by the dashed lines in FIG. 2.

In order to retain extrusions 28*a*, 28*b*, 30*a* and 30*b* assembled with panel 12, triangular corner plates 71 are inserted in recesses 36 and 56 of adjacent extrusions 28*a*, 28*b*; 28*b*, 30*a*; 30*a*, 30*b*; and 30*b*, 28*a*. A fastening device, such as a screw (not shown) is then screwed through extrusions 28, 28*b*, 30*a* and 30*b*, and through corner plates 71, thereby holding the assembly together. It will be appreciated that this is not required for the structural integrity of the system, but is merely provided to enable the panels 12 and extrusions 28 and 30 to be assembled off premises and then transported and assembled at a premises.

In order to start the assembling process, a starter extrusion 72 is provided, as shown in FIGS. 7 and 8, which is the same as first fastening extrusion 28, that is, with an elongated planar section 74, recess 78, narrow channel 79, U-shaped retaining wall 80, first right angle retaining wall section 82, second right angle retaining wall section 84, inwardly directed recess 86, L-shaped stabilizing wall 88, first stabilizing wall section 90 and second stabilizing wall section 92 corresponding respectively to elongated planar section 32, recess 36, narrow channel 37, U-shaped retaining wall 38, first right angle retaining wall section 40, second right angle retaining wall section 42, inwardly directed recess 44, L-shaped stabilizing wall 46, first stabilizing wall section 48 and second stabilizing wall section 50. However, in place of tongue 34, starter extrusion 72 includes an extension 76 which is coplanar with elongated planar section 74 and having a narrow channel 77 on one surface thereof and a large open channel 81 on an opposite surface thereof.

Figure 5:
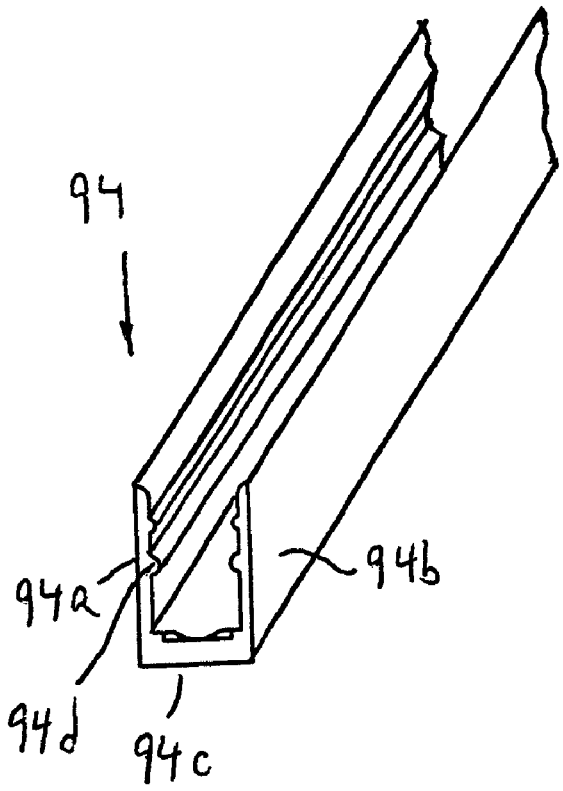
FIG. 5 is a perspective view of a U-shaped channel for securing the extrusions to the wall structure.

As shown in FIG. 7, which shows a side wall 14*a* and a floor 14*b* of wall structure 14, starter extrusion 72 is assembled with elongated planar section 74 flush against side wall 14*a* and with the free facing edge of extension 76 flush against floor 14*b*. One or two screws can be screwed through extension 7.6 in channel 77 and then into side wall 14*a* to hold starter extension 72 in position. Then, a wall panel 12*a* is assembled with starter extension 72 such that second right angle hook panel section 24 is inserted into inwardly directed recess 86, first right angle hook panel section 22 is flush against first stabilizing wall section 90 and the rear surface of planar main panel section 16 of wall panel 12*a* is flush against second stabilizing wall section 92. A U-shaped channel 94 (FIG. 5) formed by two parallel side walls 94*a* and 94*b*, and a connecting wall 94*c*, is then inserted in the space between floor 14*b* and first right angle hook panel section 22 such that connecting wall 94*c* is flush against extension 76. Screws can then be screwed through connecting wall 94*c*, extension 76 in channel 77 and then into side wall 14*a* to hold starter extension 72 in position. An elongated rubber plug 96 can then be inserted into channel 94 to provide an aesthetic appearance. In this regard, the inner surfaces of side walls 94*a* and 94*b* can be formed with beads 94*d*, and the outer surfaces of plug 96 can be formed with at least one elongated recess 96*a* for engagement by beads 94*d*.

It will be appreciated that the lowermost panel 12*a* of FIG. 8 has starter extrusion 72 in place of first extrusion 28*a* in the arrangement of FIG. 2. However, first extrusion 28*b* and second extrusions 30*a* and 30*b* are also assembled at different sides of wall panel 12*a*.

Then, as shown in FIG. 4, a next wall panel 12*b* is assembled such that first extrusion 28*a* assembled with wall panel 12*b* is connected with second extrusion 30*a* assembled with wall panel 12*a*, that is, with tongue 34 being inserted into groove 54. U-shaped channel 94 is then inserted in the space between facing outer surfaces of first right angle panel sections 22 of wall panels 12*a* and 12*b*, and is positioned flush against elongated planar section 52 of second fastening extrusion 30*a*. Fastening devices, such as screws 98 are then screwed through connecting walls 94*c*, and elongated planar sections 32 and 52, including tongues 34, into side wall 14*a*. Rubber plugs 96 are then inserted into channels 94.

The same operation occurs at the adjacent sides of each wall panel 16. This operation continues until the wall panels 12 reach the ceiling (not shown), and the same operation is performed, as was performed at floor 14*b*, by using starter extrusion 72.

Figure 9:
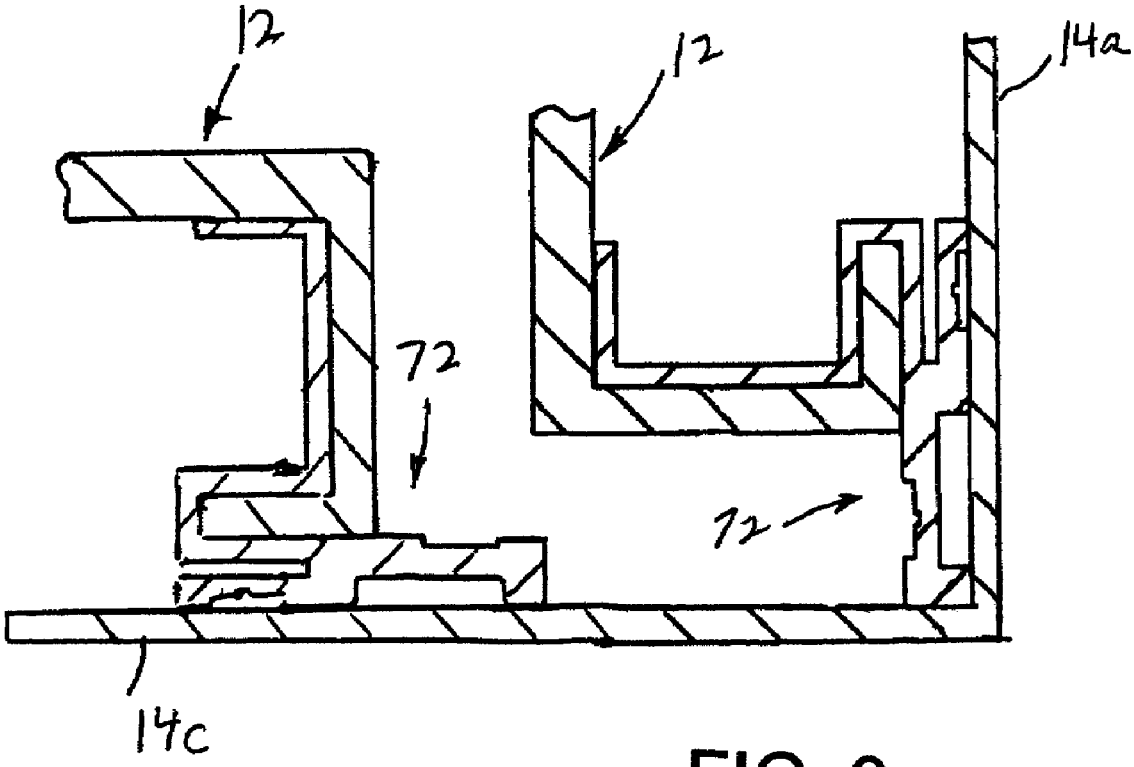
FIG. 9 is a horizontal cross-sectional view showing two starter extrusions mounted to two adjacent wall panels at a corner of the wall structure.
Figure 10:
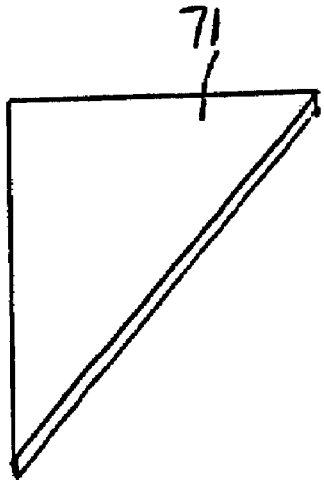
FIG. 10 is a perspective view of a corner securing member.

FIG. 9 shows the assembly at the corner of adjacent side walls 14*a* and 14*c*. Specifically, starter extrusions 72 are used for the edges of side panels 12 at the corners. U-shaped channels 94 (not shown in FIG. 9) are also preferably assembled with starter extrusions 72 in the same manner as previously discussed. In addition, a rubber plug 96 (not shown in FIG. 9) can be inserted between adjacent corner panels 12.

It will therefore be appreciated that a novel system 10 for easily mounting wall panels 12 over an existing wall structure 14 has been described which does not require the use of fastening devices to secure wall panels 12 to main fastening extrusions 26 or starter extrusions 72, and specifically, in which each wall panel 12 has a U-shaped hooked structure 20 at its ends which are securely held at extrusions 26 and 72 without any fastening devices, such as screws or the like. This arrangement prevents wall panels 12 from being pulled out away from existing wall structure 14. Further, wall system 10 is easy to assemble with an existing wall structure 14 and in which extrusions 14 by fastening devices, thereby increasing the structural integrity thereof. Also, extrusions 28, 30 and 72 are assembled flush against an existing wall, thereby adding to the structural integrity.

It will be appreciated that various modifications can be made to the present invention within the scope of the claims. For example, second stabilizing wall sections 50 and 70 can be eliminated. As another alternative, channels 94 can be eliminated, and rubber plugs 96 merely inserted in the gap between adjacent wall panels 12.

With the above arrangement, however, screws 96 must be screwed through connecting walls 94*c*, and elongated planar sections 32 and 52, including tongues 34, into side wall 14*a*. In practice, this may be time-consuming and burdensome. Further, in practice, it may become difficult to perfectly align all of the panels together with the fastening extrusions 28 and 30.

Therefore, referring now to FIGS. 11-14, there is shown a system 110 according to a second embodiment of the present invention for easily mounting wall panels 12 over an existing wall structure 14, in which elements corresponding to those of FIGS. 1-10 are identified by the same reference numerals, and a detailed description thereof is not provided, and modified elements corresponding to those of FIGS. 1-10 are identified by the same reference numerals augmented by 100.

Specifically, first fastening extrusion 128 is modified from first fastening extrusion 28 by deleting first stabilizing wall section 48 and second stabilizing wall section 50.

The elongated side edge of planar section 132 of first fastening extrusion 128 opposite tongue 134 includes a recess 136 therein. Recess 136 can extend the entire length of planar section 132, or alternatively, can be formed only at the ends of planar section 132. A shallow channel 137 is formed in the outer surface of planar section 132 in alignment with recess 136.

A U-shaped retaining wall 138 is formed at the same side edge of elongated planar section 132 as recess 136. Specifically U-shaped retaining wall 138 is defined by planar section 132, a first right angle retaining wall section 140 at the opposite side edge of elongated planar section 132 and extending at a right angle away from planar section 132, and a second right angle retaining wall section 142 at the outer free side edge of first right angle retaining wall section 140 and extending at a right angle thereto, such that second right angle retaining wall section 142 is positioned in front of elongated planar section 132 and in spaced, parallel relation thereto. U-shaped retaining wall 138 thereby defines an inwardly directed recess 144 therein for receiving second right angle panel section 24 of hook structure 20 of a respective wall panel 12.

Figure 11:
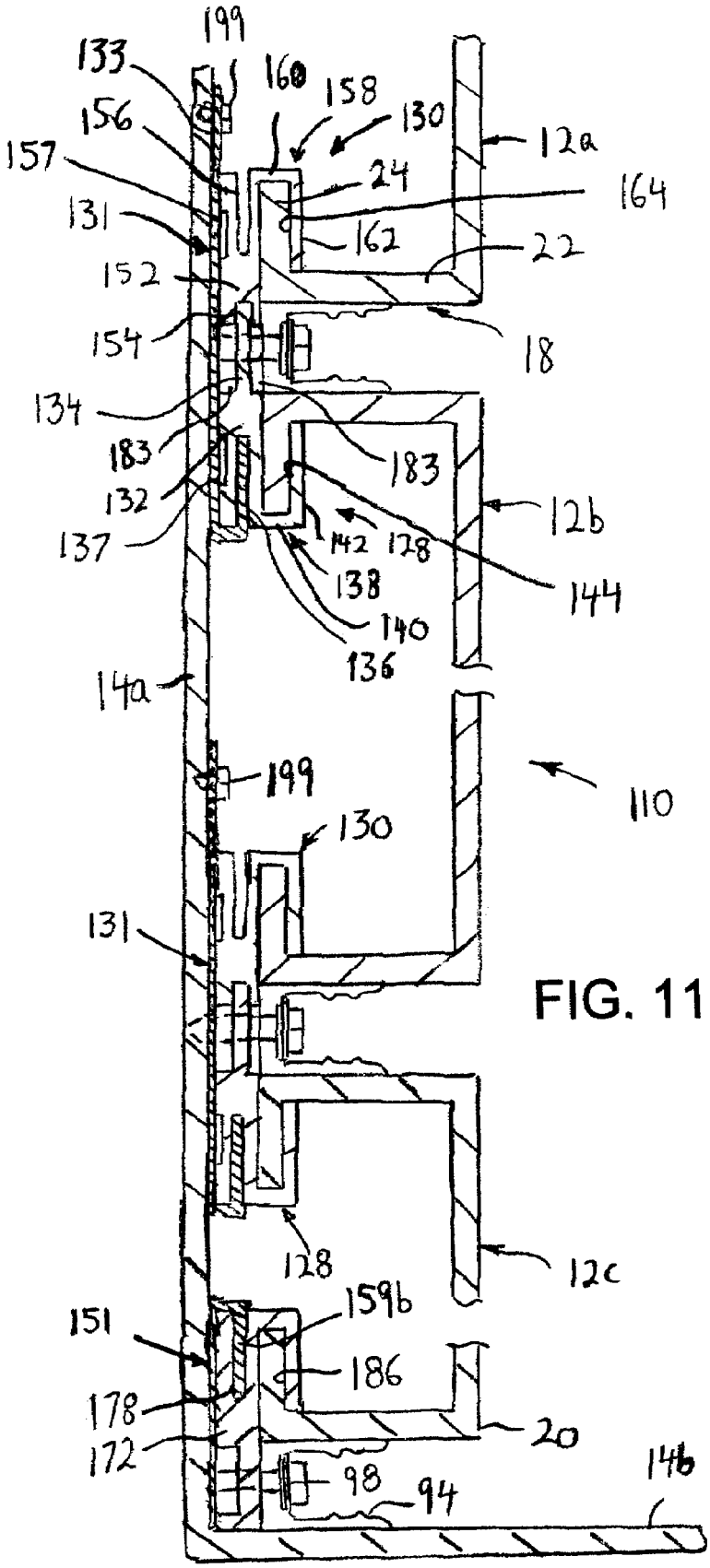
FIG. 11 is a vertical cross-sectional view showing a plurality of wall panels secured to an existing wall structure by the extrusions according to a second embodiment of the present invention.

Second fastening extrusion 130 is modified from first fastening extrusion 30 by deleting first stabilizing wall section 68 and second stabilizing wall section 70, and by shortening elongated planar section 152, thereby reducing the depth dimension of groove 154 therein. In this regard, only a distal portion of tongue 134 of first fastening extrusion 128 extends into groove 154. As a result of this construction, and as shown in FIG. 11, screw 98 does not extend through elongated planar section 152 of second fastening extrusion 130, making assembly much easier. This is because there are dead or open space areas 183 on opposite sides of tongue 134 to which elongated planar section 152 does not extend.

As with the first embodiment, the opposite elongated side edge of planar section 152 includes a recess 156 therein. Recess 156 can extend the entire length of planar section 152, or alternatively, can be formed only at the ends of planar section 152. A shallow channel 157 is formed in the outer surface of planar section 152 in alignment with recess 156.

Second fastening extrusion 130 also includes, as with the first embodiment, a U-shaped retaining wall 158 formed at the same side edge of elongated planar section 152 as recess 156. Specifically U-shaped retaining wall 158 is defined by planar section 152, a first right angle retaining wall section 160 at the opposite side edge of elongated planar section 152 and extending at a right angle away from planar section 152, and a second right angle retaining wall section 162 at the outer free side edge of first right angle retaining wall section 160 and extending at a right angle thereto, such that second right angle retaining wall section 162 is positioned in front of elongated planar section 152 and in spaced, parallel relation thereto. U-shaped retaining wall 158 thereby defines an inwardly directed recess 164 therein for receiving second right angle panel section 24 of hook structure 20 of a respective wall panel 12.

Figure 12:
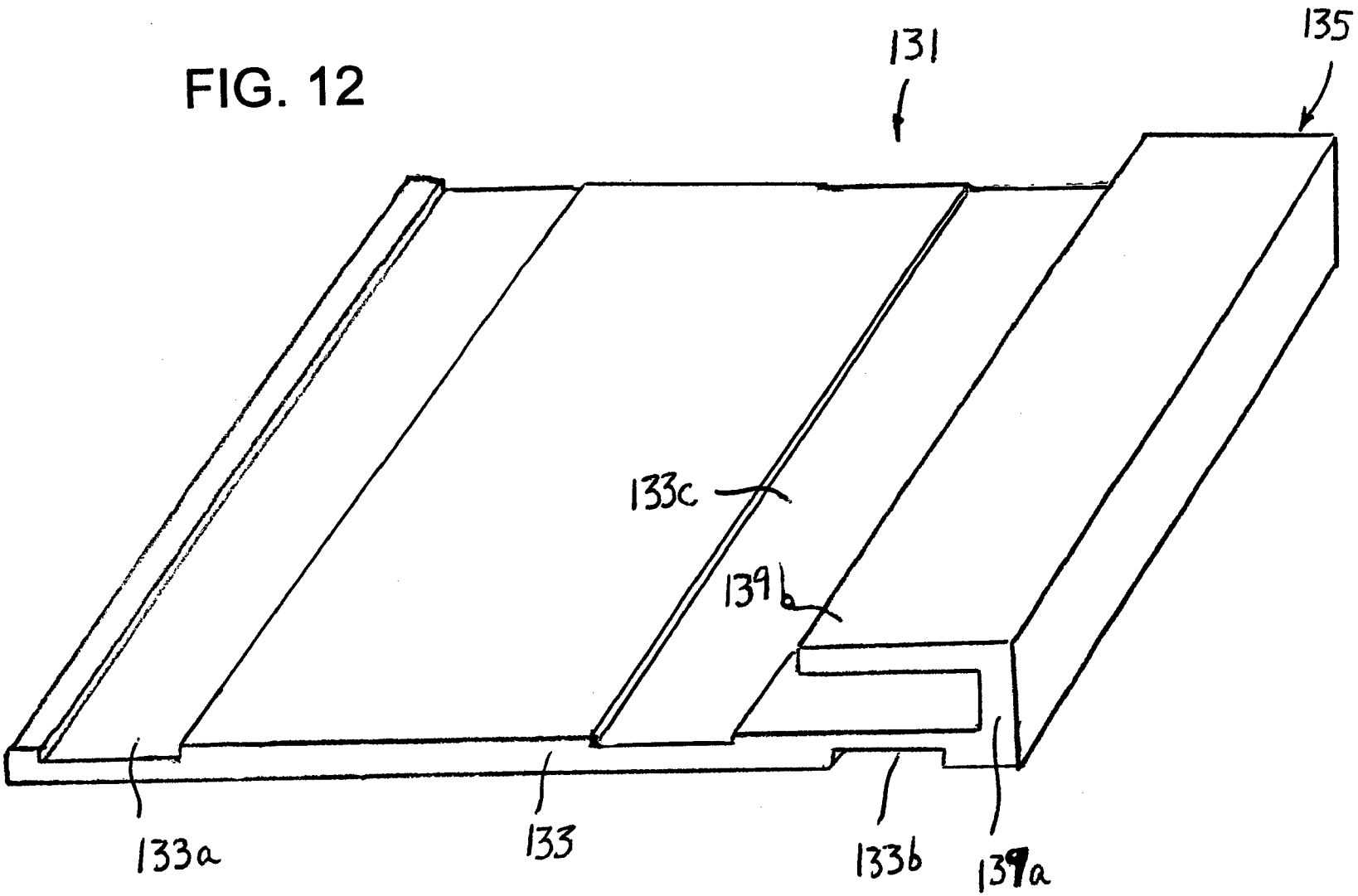
FIG. 12 is perspective view of a third fastening extrusion according to the second embodiment of the present invention.

In order to further increase stability while making assembly of the panels 12 easier, and in accordance with another aspect of the present invention, a third fastening extrusion 131, as shown best in FIGS. 11 and 12, is assembled therewith. Third fastening extrusion 131 includes an elongated planar section 133 having a first inwardly directed L-shaped engagement wall 135 at one edge thereof, with a first wall section 139*a* extending perpendicular from the edge of elongated planar section 133 and a second wall section 139*b* connected to the free edge of first wall section 139*a* and extending perpendicular thereto so as to extend in parallel spaced apart relation from elongated planar section 133. The opposite end of elongated planar section includes a channel 133*a* defining a reduced thickness section. The underside of planar section 133 has a recess 133*b* immediately below second wall section 139*b* and the opposite surface of planar section 133 includes a further recess 133*c* adjacent thereto.

Figure 13:
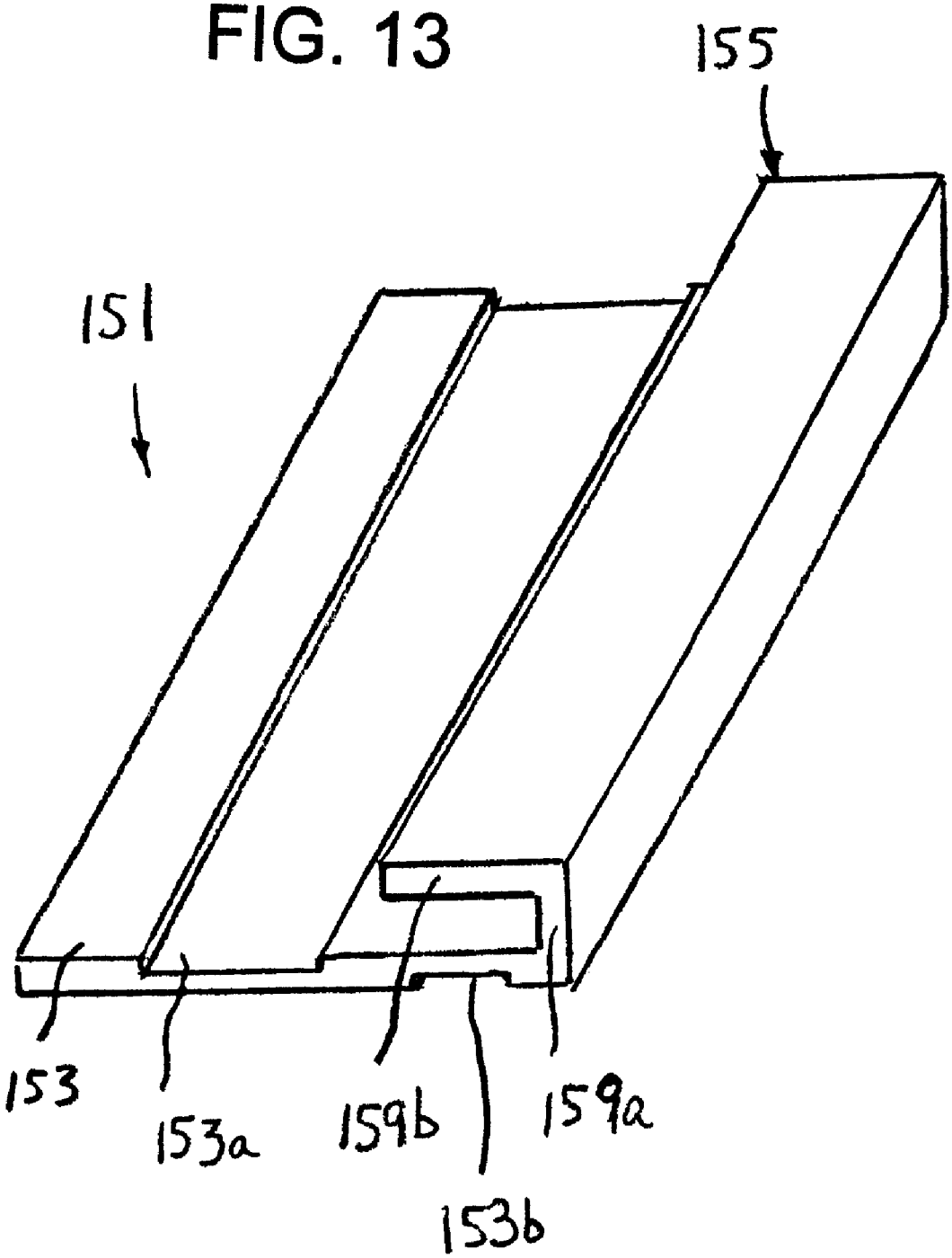
FIG. 13 is a perspective view of a fourth corner fastening extrusion according to the second embodiment of the present invention.
Figure 14:
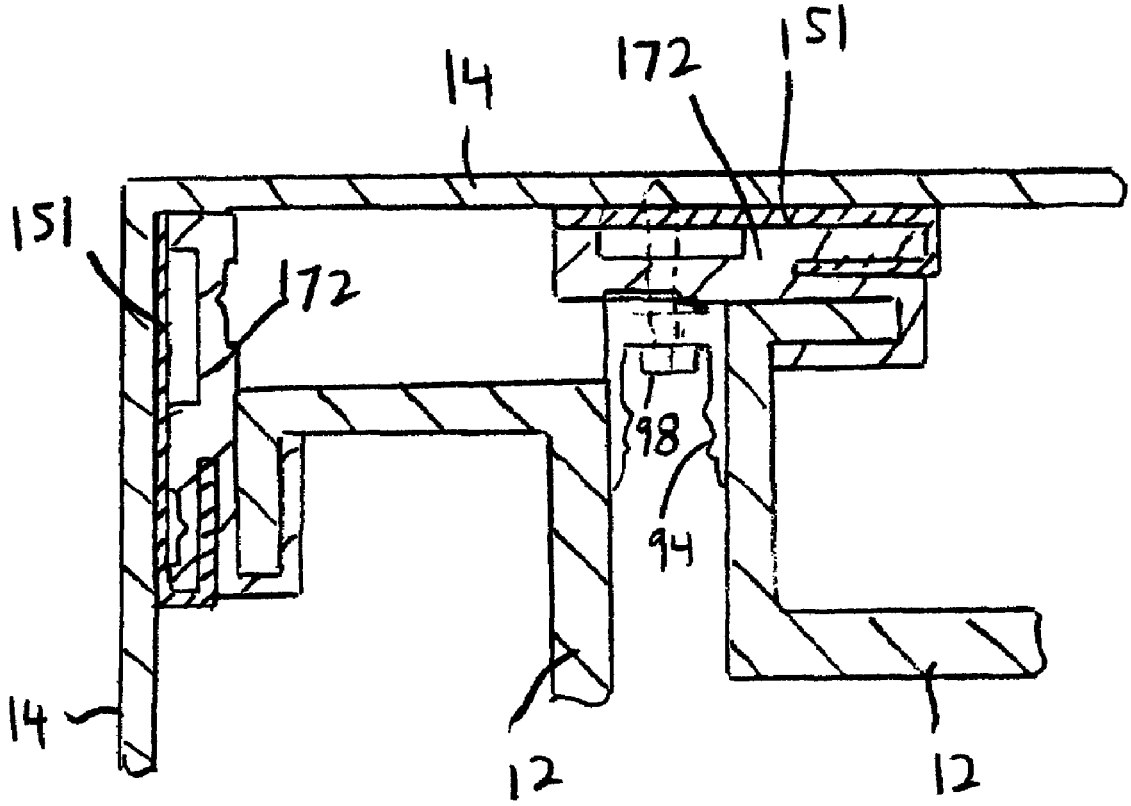
FIG. 14 is a horizontal cross-sectional view showing two starter extrusions and two fourth corner fastening extrusion mounted to two adjacent wall panels at a corner of the wall structure according to the second embodiment of the present invention.

In addition, a fourth corner fastening extrusion 151, as shown best in FIGS. 13 and 14, includes an elongated planar section 153 having a first inwardly directed L-shaped engagement wall 155 at one edge thereof, with a first wall section 159*a* extending perpendicular from the edge of elongated planar section 153 and a second wall section 159*b* connected to the free edge of first wall section 159*a* and extending perpendicular thereto so as to extend in parallel spaced apart relation from elongated planar section 153. Elongated planar section 153, at a position spaced from the free edge of second wall section 159*b*, has a recess or channel 153*a* therein in order to reduce the thickness thereof. It will be appreciated that the length of elongated planar section 153 is much less than that of elongated planar section 133. The underside of planar section 153 has a recess 153*b* immediately below second wall section 159*b*.

In order to assemble the panels 12, a person starts from the floor 14*b* and works up side wall 14*a*, as shown in FIG. 11. Specifically, a fourth corner fastening extrusion 151 is preassembled with a starter extrusion 172 by inserting second wall section 159*b* into recess 178 thereof. It will be appreciated that starter extrusion 172 is identical to starter extrusion 72, except that first stabilizing wall section 90 and second stabilizing wall section 92 are eliminated. The opposite edges of fourth corner fastening extrusion 151 and starter extrusion 72 are then placed flush against floor 14*b*, and screws (not shown) are inserted through both pieces into side wall 14*a*. Thereafter, U-shaped hook structure 20 of wall panel 12*c* is inserted into inwardly directed recess 186 of starter extrusion 172. A U-shaped channel 94 is also placed against floor 14*b* and screws 98 are inserted through all three pieces into side wall 14*a*. A plug 96 is then inserted into U-shaped channel 94.

The U-shaped hook structure 20 at the opposite upper side of wall panel 12*c* has been preassembled with first fastening extrusion 128 and third fastening extrusion 131, with second wall section 139*b* being inserted into recess 136 and with U-shaped hook structure 20 being inserted into inwardly directed recess 144. Screws (not shown) which extend through recess 133*b*, shallow channel 137 of first fastening extrusion 128 and U-shaped hook structure 20, hold these elements together. In this position, the free end of the pre-assembled third fastening extrusion 131, in channel 133*a* thereof, is screwed into side wall 14*a* by screws 199 along the entire length thereof. Then, second fastening extrusion 130, which is pre-assembled with the lower U-shaped hook structure 20 of another wall panel 12*b* by screws (not shown) extending through shallow channel 157, is assembled with first fastening extrusion 128 by tongue 134 and groove 154. The U-shaped hook structure 20 at the opposite upper side of wall panel 12*b* has been preassembled with a first fastening extrusion 128 and third fastening extrusion 131 in the manner described above with panel 12*c*. In this position, the free end of the pre-assembled third fastening extrusion 131, in channel 133*a* thereof, is screwed into side wall 14*a* by screws 199 along the entire length thereof. Then, a U-shaped channel 94 is held between the adjacent hook structures 20 of panels 12*b* and 12*c* by screws 98 which are screwed through tongue 134, recess 133*c* of planar section 133 of third fastening extrusion 131 and then into wall 14*a*. An elongated rubber plug 96 is then inserted into each channel 94 to provide an aesthetic appearance.

This assembly process continues until the top of wall 14*a* is reached, wherein another starter extrusion 172 is assembled thereat. This process also continues in the same way in a sidewards direction of each panel 12 until the entire wall structure is assembled.

Figure 15:
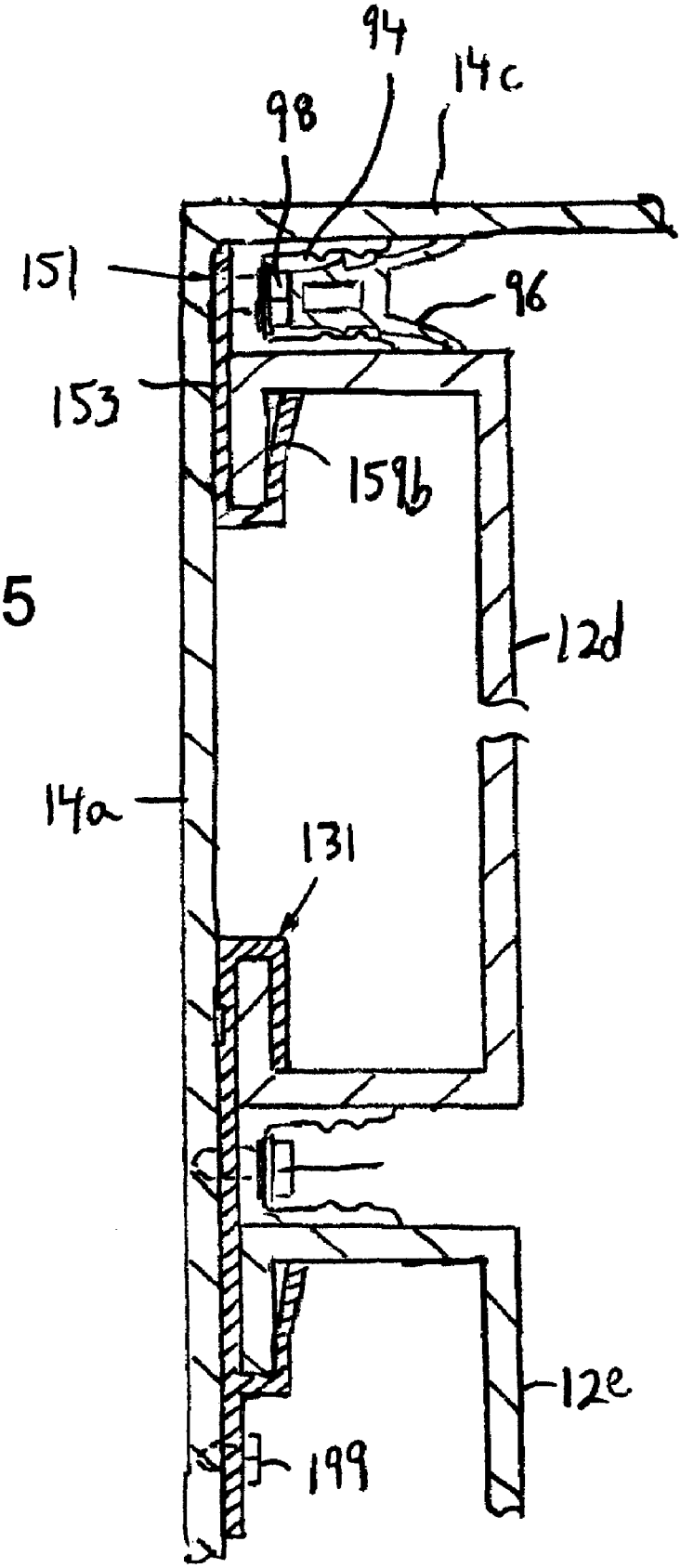
FIG. 15 is a vertical cross-sectional view showing a plurality of wall panels secured to an existing wall structure by the extrusions according to a third embodiment of the present invention.
Figure 16:
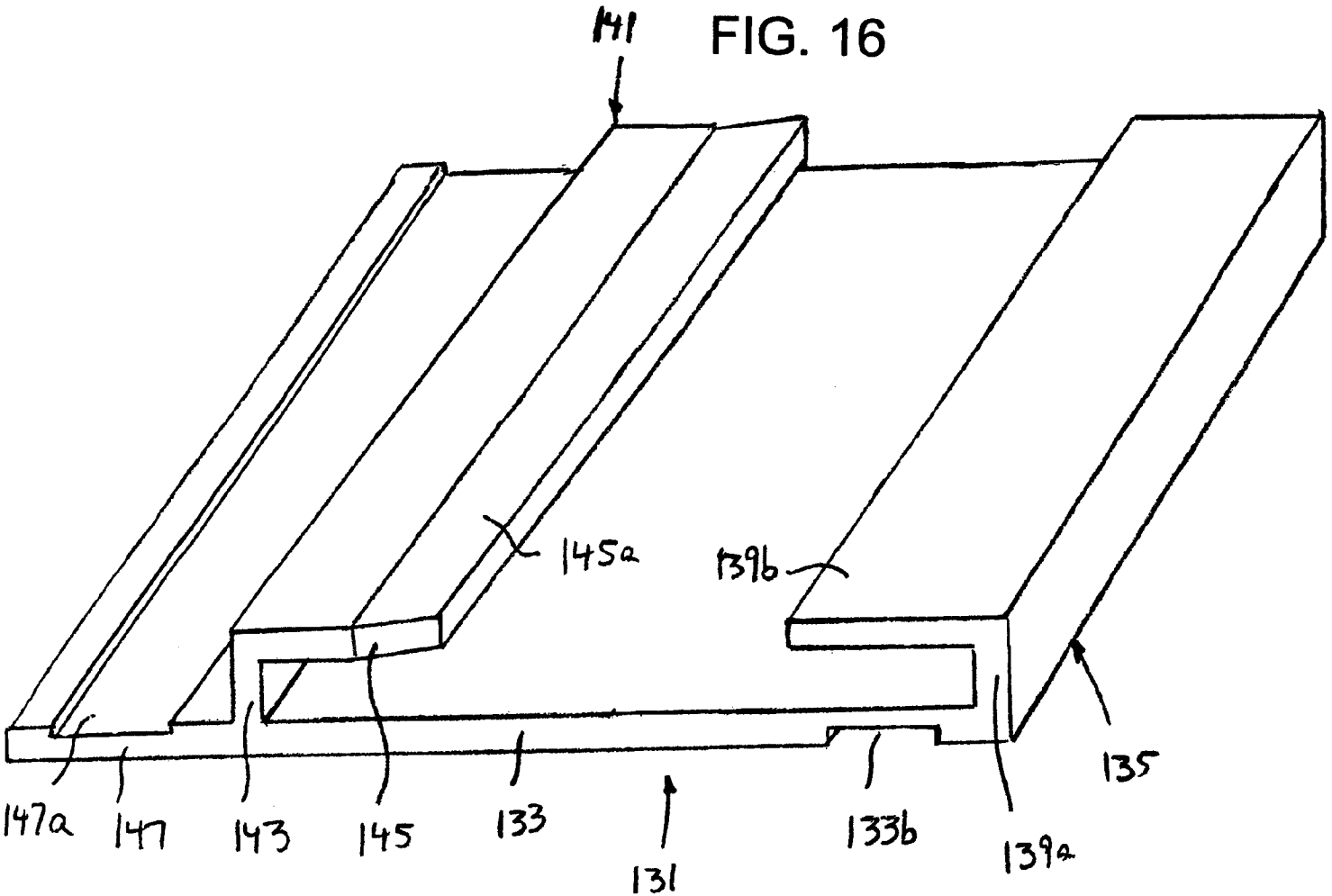
FIG. 16 is perspective view of a modified third fastening extrusion according to the third embodiment of the present invention.
Figure 17:
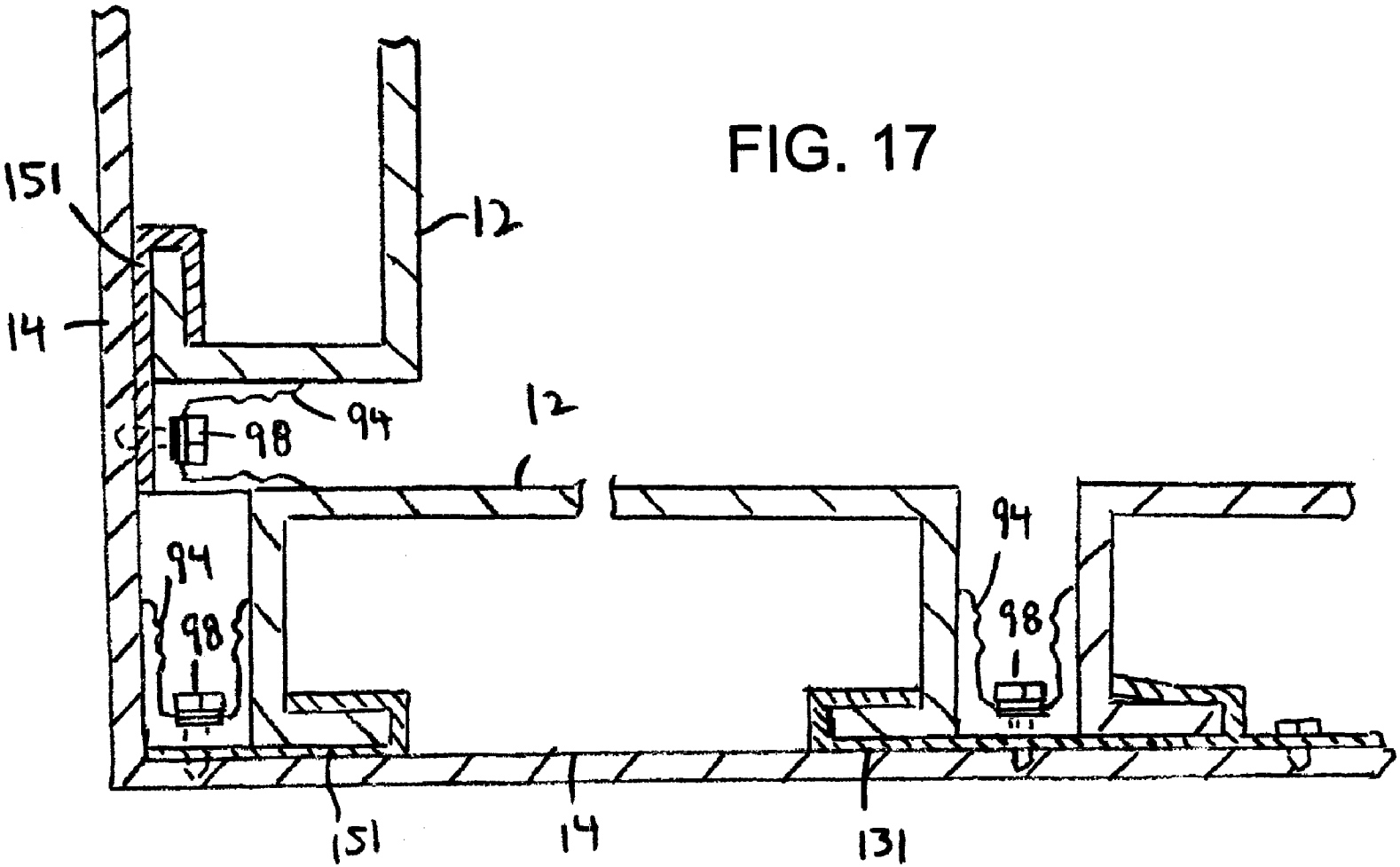
FIG. 17 is a horizontal cross-sectional view showing two fourth corner fastening extrusion mounted to two adjacent wall panels at a corner of the wall structure according to the third embodiment of the present invention.

It will be appreciated that first fastening extrusion 128 and second fastening extrusion 130 of the second embodiment can be eliminated at each juncture of panels 12, as shown by the modified third embodiment of the present invention of FIGS. 15-17.

As shown in FIGS. 15 and 16, third fastening extrusion 131 is modified to further include a second inwardly directed L-shaped engagement wall 141 which extends from the same side as elongated planar section 133 as L-shaped engagement wall 135, and is in facing relation to first inwardly directed L-shaped engagement wall 135. Specifically, second inwardly directed L-shaped engagement wall 141 includes a first wall section 143 extending perpendicular from elongated planar section 133 at a position spaced about one-quarter of the length of second inwardly directed L-shaped engagement wall 141, measured from the opposite edge thereof, although the present invention is not limited to these dimensions, and a second wall section 145 connected to the free edge of first wall section 143 and extending perpendicular thereto so as to extend in parallel spaced apart relation from elongated planar section 133. The heights of first wall sections 139*a* and 143 are the same so that second wall sections 139*b* and 145 are coplanar. With this arrangement, elongated planar section 133 forms a tail wall section 147 to the outside of second inwardly directed L-shaped engagement wall 141. Tail wall section 147 has a recess 147*a* extending therealong in order to reduce the thickness thereof. Preferably, a distal portion of wall 145 is angled slightly away from planar section 133.

In this regard, as shown in FIG. 15, the edge of fourth corner fastening extrusion 151 is placed flush against the ceiling 14*c*, and is screwed into side wall 14*a* by screws (not shown) along the entire length thereof at the end thereof adjacent ceiling 14*b* and within recess 153*a*. Thereafter, a U-shaped hook structure 20 of a wall panel 12*d* is inserted into the inwardly directed recess defined by first inwardly directed L-shaped engagement wall 155 of fourth corner fastening extrusion 151. To assist in such insertion, a portion of wall 159*b* thereof can be angled slightly away from planar section 153. Alternatively, U-shaped hook structure 20 can be pre-assembled with fourth corner fastening extrusion 151 by screws (not shown). Then, a U-shaped channel 94 is placed against ceiling 14*c* and screws 98 are inserted through connecting wall 94*c* of U-shaped channel 94 and through fourth corner fastening extrusion 151 into side wall 14*a*. An elongated rubber plug 96 can then be inserted into each channel 94 to provide an aesthetic appearance.

The U-shaped hook structure 20 at the opposite lower side of the wall panel 12*d* has been preassembled with L-shaped engagement wall 135 of a third fastening extrusion 131. Therefore, when this panel 12 is hung from fourth corner fastening extrusion 151, tail section 147 of the pre-assembled third fastening extrusion 131 is screwed into side wall 14*a* by screws 199 along the entire length thereof. Then, U-shaped hook structure 20 of another wall panel 12*e* is inserted into the inwardly directed recess defined by second inwardly directed L-shaped engagement wall 141 of third fastening extrusion 131. To assist in such insertion, a portion 145*a* of second wall section 145 thereof can be angled slightly away from planar section 133, as shown best in FIGS. 15 and 16. This assembly process continues until the bottom of wall 14*a* is reached, wherein another fourth corner fastening extrusion 151 is assembled thereat. This process also continues in the same way in a sidewards direction of each panel 12 until the entire wall structure is assembled. At each juncture of panels 12, a U-shaped channel 94 is held between the adjacent hook structures 20 by screws 98 which are screwed through planar section 133 of third fastening extrusion 131 and then into wall 14*a*. An elongated rubber plug 96 can then be inserted into each channel 94 to provide an aesthetic appearance.

Of course, it will be appreciated that triangular corner plates 71 are still used with the second and third embodiments in the same manner as the first embodiment.

It will be appreciated that various modifications can be made to the present invention within the scope of the claims. For example, fourth corner fastening extrusion 151 can be formed from third fastening extrusion 131 by forming the latter with a weakened line therealong to be effectively snapped or cut in half, leaving a portion of planar section 133 and first inwardly directed L-shaped engagement wall 135 forming fourth corner fastening extrusion 151.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall structure, comprising:

a plurality of wall panels, each wall panel having a main panel section and L-shaped hook walls at edges of the main panel section, each L-shaped hook wall including a first right angle panel section at each free side edge of the main panel section which extends at a right angle away from the main panel section, and a second right angle panel section which extends inwardly at a right angle from a free side edge of the first right angle panel section such that each second right angle panel section is positioned behind the main panel section in spaced, parallel relation thereto, with the main panel section and each L-shaped hook wall together defining a U-shaped cross-sectional profile;

a plurality of unitary, single piece fastening extrusions, each fastening extrusion including:

a planar section having a length, a first retaining wall structure near one end of the fastening extrusion and adjacent the securing section, the first retaining wall structure including a recess which opens in a first direction and receives one said hook wall of said wall panel, said first retaining wall structure being spaced from said one end of said fastening extrusion, a second retaining wall structure near another end of the fastening extrusion, the second retaining wall structure including a recess which opens in a second direction opposite to said first direction and receives one said hook wall of another said wall panel, said first retaining wall structure and said second retaining wall structure extend from a same side of said planar section, a first securing section for securing the fastening extrusion to the existing wall structure, said first securing section including a tail section of said planar section which extends between said one edge and said first retaining wall, and a second securing section for securing the fastening extrusion to the existing wall structure, said second securing section including part of said planar section positioned between said first and second retaining walls; and a closure member secured to the second securing section of each fastening extrusion and positioned between adjacent wall panels corresponding thereto.

2. A system according to claim 1, wherein said main panel section has a rectangular configuration with four said hook walls, with the recess of the retaining wall of each fastening extrusion receiving one said hook wall of said wall panel.

3. A system according to claim 1, wherein each retaining wall structure has an L-shaped cross-sectional profile which faces the L-shaped cross-sectional profile of the other retaining wall structure.

4. A system according to claim 3, wherein at least one of said L-shaped cross-sectional profiles is angled away from said planar section by a small angle.

5. A system according to claim 1, wherein said planar section and each said retaining wall structure together define a U-shaped cross-sectional profile that defines the respective said recess.

6. A system according to claim 1, further including a corner fastening extrusion for starting assembly at a corner wall, the corner fastening extrusion including:

a planar wall section for securing the fastening extrusion to the existing wall structure, and a first retaining wall structure near one end of the planar wall section, the first retaining wall structure including a recess which receives one hook wall of a wall panel.

7. A system according to claim 6, wherein the corner fastening extrusion is used at edges of a respective said wall panel corresponding to corners between:

a side wall and floor, two side walls, and a side wall and a ceiling.

8. A system according to claim 1, wherein the closure member includes at least one channel secured to the second securing section of each fastening extrusion and positioned between adjacent wall panels corresponding thereto.

9. A system according to claim 8, further comprising an elongated plug inserted into each channel for closing off the channel.

10. A system for mounting wall panels to an existing wall structure, comprising:

a plurality of wall panels, each wall panel having a main panel section and hook walls at edges of the main panel section, with the main panel section and each hook wall together defining a U-shaped cross-sectional profile;

a plurality of first fastening extrusion assemblies, each fastening extrusion assembly including:

a securing section for securing the fastening extrusion assembly to the existing wall structure, a first retaining wall structure near one end of the fastening extrusion assembly and adjacent the securing section, the first retaining wall structure including a first recess which receives one said hook wall of said wall panel and a second recess, and a second retaining wall structure near another end of the fastening extrusion assembly, the second retaining wall structure including a third recess which receives one said hook wall of another said wall panel and a fourth recess; and a second fastening extrusion assembly, each second fastening extrusion assembly including:

a securing section for securing the second fastening extrusion assembly to the existing wall structure, a first L-shaped retaining wall structure near one end of the fastening extrusion, the first L-shaped retaining wall structure extending into one of the second and fourth recess.

11. A system according to claim 10, wherein each of said first fastening extrusion assemblies includes a first fastening extrusion and a second fastening extrusion, a first one of said fastening extrusions includes a tongue and a second one of said fastening extrusions includes a groove for receiving said tongue to connect together said first and second fastening extrusions when said first fastening extrusion is assembled with a first wall panel and said second fastening extrusion is assembled with a second wall panel.

12. A system according to claim 11, wherein a depth of each tongue is greater than a depth of each groove such that each tongue does not fit entirely in the respective groove.

13. A system according to claim 10, further comprising at least one channel secured to the first and second fastening extrusion assemblies and positioned between adjacent wall panels corresponding thereto.

14. A system according to claim 13, further comprising an elongated plug inserted into each channel for closing off the channel.

15. A system according to claim 10, wherein said main panel section has a rectangular configuration with four said hook walls, and there are four said first and second fastening extrusion assemblies associated with each main panel section, with the first and third recesses of the first and second retaining walls receiving one said hook wall of said wall panel.

16. A system according to claim 10, further comprising:

a starter extrusion for starting assembly at a corner wall, comprising:

a securing section for securing the starter extrusion to the existing wall structure, and a first retaining wall structure connected with the securing section of the starter extrusion and including a fifth recess which receives one said hook wall of another said wall panel and a sixth recess, and a corner fastening extrusion for starting assembly at a corner wall, the corner fastening extrusion including:

a planar wall section for securing the corner fastening extrusion to the existing wall structure, and a first retaining wall structure at one end of the planar wall section, the first retaining wall structure including an L-shaped retaining wall structure extending into the sixth recess.

17. A system according to claim 16, wherein the starter extrusion and corner fastening extrusion are used at edges of a respective said wall panel corresponding to corners between:

a side wall and floor, two side walls, and a side wall and a ceiling.

* * * * *